United States Patent [19]

Wild

[11] 4,170,096

[45] Oct. 9, 1979

[54] PACKER GRID BLOCK ASSEMBLY WITH DETACHABLE GUIDING FINGERS

[76] Inventor: Anton J. Wild, 310 Springfield Ave., Westfield, N.J. 07092

[21] Appl. No.: 926,583

[22] Filed: Jul. 20, 1978

[51] Int. Cl.[2] ..... B65B 39/02

[52] U.S. Cl. ..... 53/248; 193/32

[58] Field of Search ..... 53/248; 193/32, 40

[56] References Cited

U.S. PATENT DOCUMENTS

| | | | |
|---|---|---|---|
| 3,031,820 | 5/1962 | Schulze et al. | 53/248 X |
| 3,271,928 | 9/1966 | Wild | 53/248 |
| 3,325,967 | 6/1967 | Wild | 53/262 |
| 3,479,791 | 11/1969 | Wild | 53/248 X |
| 3,788,034 | 11/1974 | Hartness et al. | 53/248 |
| 3,911,647 | 10/1975 | Hartness et al. | 53/248 |
| 3,922,836 | 12/1975 | McGill | 53/248 |
| 4,033,095 | 7/1977 | Wild | 53/48 |

*Primary Examiner*—Travis S. McGehee

*Attorney, Agent, or Firm*—Albert Sperry; Frederick A. Zoda; John J. Kane

[57] ABSTRACT

A packer grid block assembly utilizing detachably securable fingers for guiding articles into an orderly array to facilitate packing of the articles into a predefined receiving location positioned therebelow including a plurality of equally spaced parallel grid plates having mounted thereon a plurality of generally triangular support blocks which each present outwardly facing block surfaces to which a plurality of guiding fingers are detachably securable, each block surface including secured thereto a cover plate which is maintained in a spaced relationship with respect to the block surface by a plurality of spacers which serve to define a separation space between the cover plate and the support block, the finger members serving to guide articles passing through the grid may be detachably securable in a location between the cover plates and the block members by detachably securing themselves around the spacers, the elongated finger members being of a resilient material and defining a longitudinal slot therein including enlarged sections such that the slot may separate during insertion of the finger member such that the enlarged sections can grip around at least one of the spacer means to detachably secure the finger member thereto, the finger member further including a lower section extending below the cover plate and inclined inwardly toward the article receiving passage defined between adjacent fingers to facilitate the guiding of articles passing through the passages, further including a tab means or plurality of ear means which are adapted to limit lateral movement of the finger member when detachably secured in place to the spacers.

11 Claims, 11 Drawing Figures

PACKER GRID BLOCK ASSEMBLY WITH DETACHABLE GUIDING FINGERS

BACKGROUND OF THE INVENTION

1. Field of the Invention

The present invention deals with the field of packer grids which are employed in packaging machines to conduct and guide bottles into crates or cartons positioned therebelow. It is desirable to place these bottles in a predetermined arrangement to match the array of the bottle receiving carton or crate and as such the present invention provides a new and novel way for achieving this desired end.

Generally a packer grid embodies members arranged in crossed relationships to form an array of bottle guiding channels and is provided with some type of means for maintaining this accurate relative orientation. Also a means must be provided to retard the movement of bottles as they pass through the grid since the bottles if moving too fastly could be damaged. In this field the members which slow down the movement of the bottles sometimes tend to wear and may become broken or bent in such a way as to engage dividers in the crate or carton causing injury to the carton or bottles. This problem presents special difficulties when cartons are formed of light cardboard or other flexible material and as such the present invention provides a means for not only slowing the speed of the downward movement of the bottles but also a means for accurately positioning the bottles such that no damage is done to the bottles themselves or to the carton or crate positioned therebelow for receiving the bottles. Of course the present invention could be usable with any similar type of articles which need be placed into a horizontal array for movement or placement. 2. Description of the Prior Art Packer grids are usable in packaging the machines especially for use with bottles such as those best shown and described in U.S. Pat. Nos. 2,701,015; 2,727,664 and 2,753,673. Other more recently issued patents dealing with this field of art include U.S. Pat. Nos. 3,922,836; 3,911,647 and 3,788,034 as well as 3,031,820 issued May 1, 1962 to Wild and Schulze.

Of particular importance is U.S. Pat. No. 3,271,928 issued to the present inventor wherein another system is disclosed for detachably securing flexible fingers to a horizontally extending packer grid.

The present invention is distinguishable from this prior art as well as the present inventor's previous U.S. Pat. No. 3,271,928 due to the ease of securement and detachment of the fingers to the grid assembly. The present invention is structurally different from the apparatus disclosed in the U.S. Pat. No. 3,271,928 and in that manner provides a much faster snap-in and snap-out arrangement for replacement of resilient guiding fingers in any packer grid.

SUMMARY OF THE INVENTION

The present invention provides a packer grid block assembly which is useful for the guiding of articles into an orderly array to facilitate packing into receiving locations such as the movement of bottles into packing cartons and crates positioned therebelow. In order to aid in this guiding operation a plurality of resilient fingers are detachably secured to the packer grid by means of the block assembly in a way to make it very easy to snap these fingers out or to snap these fingers in.

In this manner the block surfaces of the support blocks define article receiving passages between four such block surfaces which all are approximately perpendicular to the axis of the adjacent article receiving passage. The passages themselves are actually formed by two adjacent block surfaces of adjacent supporting blocks on a given grid plate in cooperation with two adjacent block surfaces of adjacent block plates which are located upon an adjacent grid plate.

Each of the block faces includes a cover plate which is fixedly secured thereto. A separation space is maintained between the block surface and the cover plate by a spacer means located therebetween such as a collar or similar configuration. This separation space is maintained by the spacer means which is fixedly secured in place by a securement means such as screws or the like. The same securement means holds the cover plate and the block surface together.

The finger members are preferably formed of a resilient material and are detachably secured indirectly to the grid plates by being detachably secured to the collar or spacer means. In this manner the finger members themselves are actually detachably securably within the separation space. Each finger member includes an inwardly facing surface which cooperates with adjacent similarly configured fingers to define an articles receiving passage therebetween.

More particularly, each finger member includes a lower section which extends below the cover plate and is inclined inwardly toward the article receiving passage to guide the articles passing thereby. Each finger member also includes an upper neck section which is located mostly within the separation space and serves to detachably secure the entire finger member in place. This upper neck section includes a slot means which extends from the top of the finger longitudinally downward therealong and further includes at least one enlarged area which is adapted to be detachably gripped around one of the collars of the spacer means.

Preferably the present invention also includes a lateral movement restriction means which may take the form of two ear members which are integral to the cover plate and extend inwardly each on opposite sides of the finger member toward the block surface. Each ear member would be closely positioned near each lateral side of the finger member and in that way restrict lateral movement of the finger member after it has been secured in position within the separation space. Alternatively the lateral movement restriction means may include a tab means which extends inwardly from the cover plate into perhaps the slot means which is defined longitudinally in the finger members. This tab means can be perpendicular to the undersurface of the cover plate or can extend downwardly below the lower edge of the cover plate into the slot means. Alternatively the tab means need not actually extend into the slot means but may extend into a predefined recess in the finger member which has been defined to receive the tab means and thereby restrict the lateral movement of the finger member. Again alternatively, the lateral movement restriction means could comprise a second enlarged area defined within the slot means such that the first enlarged area will grip one of the collars between the cover plate and the block and the second enlarged area will grip a second such collar and in this way minimize any lateral movement of the finger member.

In order to facilitate insertion the finger members must be specifically laterally resilient in order to allow a temporary widening of the slot means during movement of the finger member into the separation space for placement of one or two of the enlarged areas around one or two of the spacer means.

Also preferably the block surfaces are inclined outwardly in a downward direction to aid in the extending of the finger members into the article guiding channels defined therebetween. Also preferably a flat spring means should be included secured to each block face between the finger member and the block surface to give added resiliency to the lower sections of the finger members which extend inwardly into the channel. This spring may include a crimped section to lessen the gap between the finger and the cover plate and to stabilize the finger by adding greater spring action. In this manner the speed of the downwardly moving bottles can be decreased if desired. Also better guiding characteristics are achievable by the inclusion of the flat spring means for providing additional resiliency.

It is an object of the present invention to provide a packer grid block assembly which facilitates the attachment and detachment of resilient guiding fingers.

It is an object of the present invention to provide a packer grid block assembly which guides bottles or other articles into an orderly array for placement into a receiving location such as a carton or case position therebelow.

It is an object of the present invention to provide a packer grid block assembly which minimizes lateral movement of detachable guiding fingers secured thereto.

It is an object of the present invention to provide an improved type of snap-in and snap-out finger for packer grids which are replaceable without dismantling any part of the finger assembly mounting.

It is an object of the present invention to provide a packer grid block assembly having detachable fingers for guiding articles which allows replacement of the fingers themselves without requiring substantial down time of the packaging equipment.

It is an object of the present invention to provide a packing grid block assembly which includes additional resiliency and biasing means such as the inclusion of an additional flat spring with each finger member to control the amount of inwardly exerted pressure by the finger members upon the bottles moving downwardly through the article receiving passages.

DETAILED DESCRIPTION OF THE PREFERRED EMBODIMENT

Figures 1, 2A, 2B, 2C:
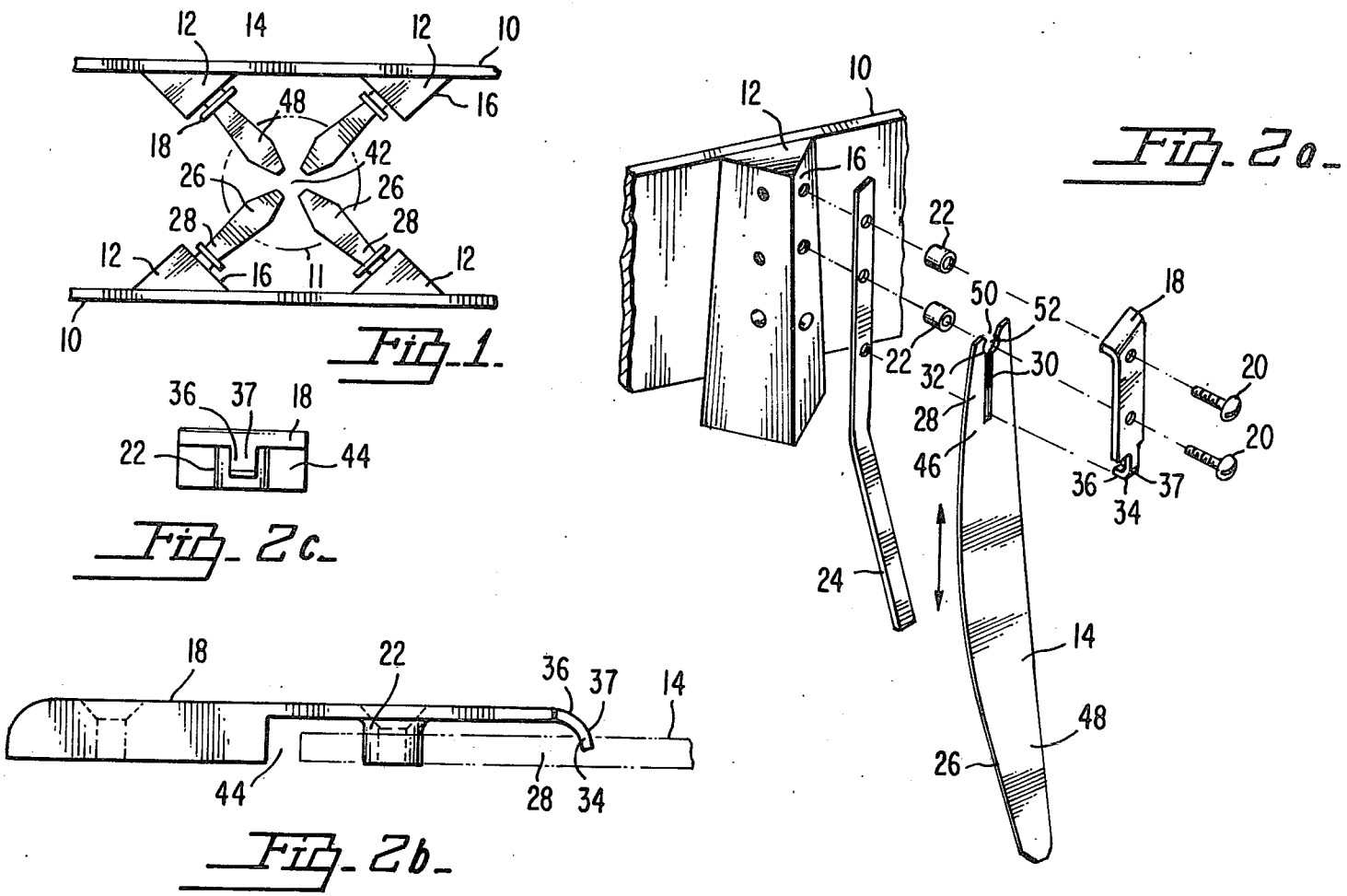
FIG. 1 is a top plan view of an embodiment of the packer grid block assembly of the present invention showing the article receiving passage.
FIG. 2A is an exploded perspective view of another preferred embodiment of the present invention showing a tab means extending below the cover plate.
FIGS. 2B and 2C show side views and end views of the embodiment of the cover plate shown in FIG. 2A.

A preferred embodiment of the packer grid block assembly of the present invention is shown in the Figures wherein various alternative configurations for resilient finger members 14 and cover plates 18 are shown. The basic grid is formed by a plurality of grid plates 10 arranged approximately parallel with respect to one another and equally spaced laterally. A plurality of support blocks 12 are mounted on both sides of each grid plate at equally spaced locations along each side thereof.

Each support block 12 is of a generally triangular configuration wherein the hypotenuse is fixedly secured to the surface of the grid plate and wherein the two smaller sides extending downwardly provide block surfaces which are perpendicular to one another and protrude such that a normal to the surface thereof is at an angle of approximately 45° with respect to the grid plates 10. In this manner the block surfaces 16 define article receiving passages 42 therebetween. Each passage 42 is defined by four block surfaces facing the axis of the passage. The article receiving passages 42 are adapted to receive passage therethrough articles such as a bottle 11 for guiding these articles into an orderly array to facilitate packing into receiving locations positioned therebelow such as crates or cartons.

A cover plate 18 is fixedly secured to each block surface 16 such as by screws 20. The cover plate is maintained in a position such that it is not in abutment with the actual block surface 16. In this manner a separation space 44 is defined between the inner surface of each cover plate 18 and each block surface 16. This spacing is achieved by the use of a spacer means such as collars 22 which fixedly secured between the cover plate 18 and spring 24 which is mounted on the block surface 16 by the securement means 20. Thus the collars 22 maintain the spacial distance therebetween.

Each of the block surfaces 16 is adapted to receive detachably secured thereto a resilient elongated finger member 14. The finger members include inwardly facing surface thereof which cooperate with adjacent similarly configured fingers to define the article receiving passages 42 therebetween from guiding articles into an orderly array for placement therebelow, the fingers basically comprise two sections including a neck portion 28 and a body portion 26. The neck portion 28 provides the means of securement between the finger member configuration 14 and the support block 12. On the other hand the neck portion 28 provides the inwardly inclined means of biasing the downwardly moving articles into proper orientation within a particular article receiving passage. To further increase the amount of inwardly directed bias at least a section of the body portion 26 may be configured as a lower inwardly inclined section 48 to further increase the inwardly directed bias. In addition, a flat spring 24 is included which is fixedly secured to the block surface 16 by the securement means 20 and includes a bottom section which is inclined inwardly toward the center of the passage 42 in order to provide an additional degree of inwardly directed bias for slowing down the speed of the downwardly moving articles or for assuring accurate orientation of any desired article configuration. Spring 24 includes a crimped section 21 which aids in biasing the finger member into detachable securement with collars 22.

Normally the flat spring 24 is secured to the block surface 16 as shown in FIGS. 2 through 5 at a position between the block surface 15 and the upper neck section 46 of the elongated resilient finger members 14.

Of particular importance in the present invention is the usage of a lateral movement restriction means 34 which is located adjacent the finger to minimize lateral play therein during continual on-line usage. The present invention provides several particular embodiments within the purview of the claims of the present invention for providing this lateral movement restriction means while at the same time providing a novel snap-in and snap-out arrangement to facilitate attachment and detachment of the finger means in place within the separation space 44 such that the finger is detachably securable indirectly to the grid plates 14 to define the array of article receiving passages 42.

Figure 5:
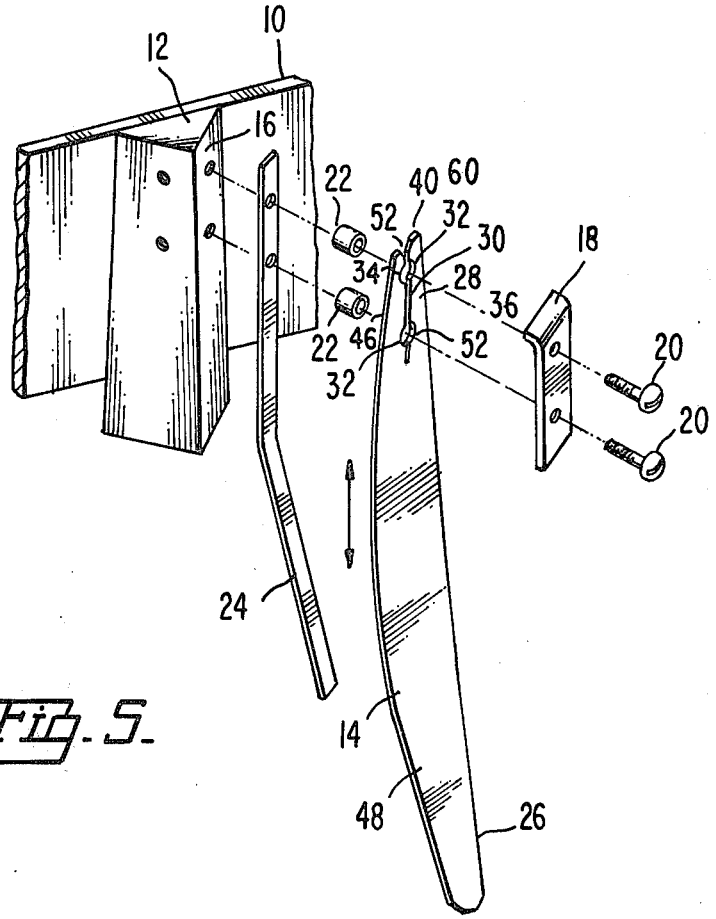
FIG. 5 is an exploded perspective view of a preferred embodiment of the present invention showing the inclusion of a second enlarged area within the slot means for providing the means for minimizing lateral movement of the finger member.

In order to provide a means for detachable securement a longitudinal slot 30 is included in the upper neck portion 28 of the finger 14. The slot means generally extends from the top of the finger member downwardly and includes at least one enlarged area 52 such as aperture 32 to facilitate gripping of the spacer means 22. The finger members 14 themselves are preferably formed of a resilient material to facilitate flexing of the body portion 26 and specifically of the lower inwardly inclined section 48 in order to allow the articles to pass through the article receiving passages 42 but while still exerting some amount of inward bias thereon. Also the resilient material of which the finger members 14 are made also provide a means of securement detachably between the slot means and at least one of said spacer means. The step of insertion is carried out by the gripping of the finger member 14 in the lower area thereof and the pushing upwardly of the finger in the separation space 44 between the cover plate 18 and the spring 24 such that the end of the slot 30 will separate since the slot itself is being forced upwardly around the spacer means 22. As the finger is urged further upwardly slot will move upward until the collar 22 engages an enlarged area 52 such as an aperture 32. When this orientation is reached an engagement will occur wherein the slot will snap closed and the enlarged area will grip the spacer means 22. In one presently contemplated configuration the finger member 14 will include a second enlarged area 60 such that one of the enlarged areas will grip one of the collars and another enlarged area will grip the other collar simultaneously. This configuration is shown in FIG. 5. With usage of such a configuration the upper enlarged area will, firstly, grip the lower collar and the installer must push the finger further upwardly such that engagement between those two members is released such that the first enlarged area passes further upwardly and grips the upper collar and the lower enlarged area is moved to the engaging location with the lower collar 22.

The lateral movement restriction means 34 of the present invention may be one of a variety of configurations including a tab means 36 extending from the cover plate inwardly into engagement with the finger member 14. The tab means may be utilized as shown in FIG. 2 including an angular tab 37 extending below the cover plate and into the lower section of the slot area which is defined further down the neck portion of the finger member below the enlarged area thereof. It should be appreciated that it is not necessary that the tab member extend into a section of the slot means extended below the enlarged area but could merely be engageable with any type of recess within the front surface of the finger member.

Figures 3A, 3B, 3C, 4A, 4B, 4C:
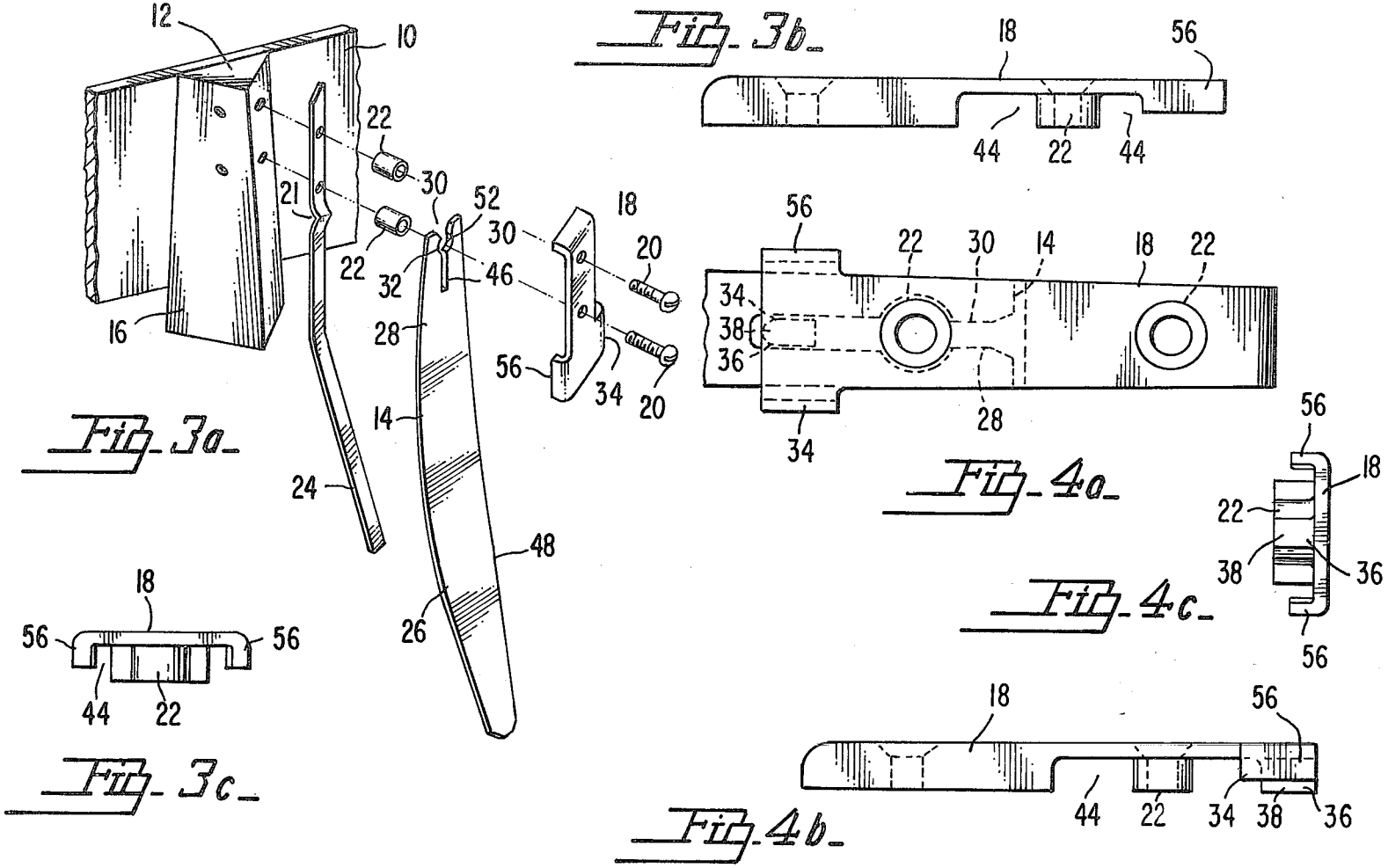
FIG. 3A is an exploded perspective view of another preferred embodiment of the present invention illustrating the inclusion of ear members on the cover plate for minimizing lateral movement of the finger member.
FIGS. 3B and 3C illustrate a side view and an end view of the cover plate shown in FIG. 3A.
FIG. 4A is a preferred embodiment of the cover plate of the present invention showing the laterally extending ear members and the perpendicular tab means for minimizing lateral movement of the finger member.
FIG. 4B and FIG. 4C show side and end views respectively of the embodiment shown in FIG. A.

It is not necessary that the tab 36 be configured as an angular tab 37 but it could be a more perpendicular tab such as shown as tab 38 wherein the tab extends directly inwardly into engagement with the finger member 14 below the cover plate 18. Another means of preventing excess lateral movement of the finger member 14 is by the inclusion of ear members 56 which may generally curl around out from the sides of the bottom area of the cover plate 18 to be in a position almost in abutment with the sides of the finger member 14 positioned underneath the cover plate 18. This configuration can be shown used as the sole means of preventing lateral movement of the fingers in FIGS. 3A, 3B, and 3C. The usage of the ear members 56 is shown in FIGS. 4A, 4B, and 4C in a configuration used in combination with the inwardly projecting perpendicular tab 38.

Another alternative means of minimizing lateral movement of the finger member 14 is the inclusion of two enlarged areas 52 defined within the longitudinal slot 50 to provide a double aperture configuration 40 by gripping both of the collars 22 located between the cover plate 18 and the spring 24 lateral shifting of the bottom section 26 of the fingers 14 is minimized. In this manner a novel means of combining an easily detachable finger member in combination with a lateral play minimizing structure is shown and claimed herein.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A packer grid block assembly having detachable fingers for guiding articles into an orderly array to facilitate packing into receiving locations positioned therebelow which comprises:

(a) a plurality of approximately parallel and equally spaced grid plates;

(b) a plurality of support blocks secured to said grid plate at approximately equally spaced locations, said support blocks including two block surfaces at approximately 90° with respect to one another and at about 45° with respect to said grid plates, said support blocks defining article receiving passages between two adjacent block surfaces of adjacent support blocks on a given grid plate and two adjacent block surfaces of adjacent support blocks on an adjacent grid plate;

(c) a plurality of cover plates each being fixedly secured to one of said block surfaces;

(d) securement means adapted to fixedly attach said cover plates to said block surfaces including spacer means fixedly positioned between said cover plates and said block surfaces to define a separation space therebetween;

(e) a plurality of elongated finger members of resilient material detachably attached indirectly to said grid plates by being detachably secured to said spacer means, said finger members being detachably positioned within said separation space, said finger members including upwardly facing surfaces thereof which cooperate with adjacent similarly configured fingers to define said article receiving passages for guiding articles into an orderly array for placement therebelow, said fingers further comprising:

(1) an upper neck section located primarily within said separation space to detachably secure said finger member in place, said upper neck section including a slot means extending from the top thereof longitudinally downward with respect to said finger member, said slot means including at least one enlarged area being adapted to detachably grip around one of said spacer means; and (2) a lower section extending below said cover plate and inclined toward said article receiving passage to guide articles passing therethrough; and (f) lateral movement restriction means located between said finger members and said spacer means and said cover plate to limit lateral movement of said finger members when detachably secured within said separation space.

2. The assembly as defined in claim 1 wherein said lateral movement restriction means comprises two ear members extending inwardly toward said block surface from said cover plate on opposite lateral sides of said finger member to restrict lateral movement thereof when secured within said separation space.

3. The assembly as defined in claim 2 wherein said ear members extend from the lowermost side edges of said cover plate.

4. The assembly as defined in claim 1 wherein said lateral movement restriction means comprises a tab means extending inwardly from said cover plate into said slot means defined longitudinally in said finger member.

5. The assembly as defined in claim 4 wherein said tab means is perpendicular to the undersurface of said cover plate.

6. The assembly as defined in claim 4 wherein said tab means extend downwardly below the lower edge of said cover plate into said slot means.

7. The assembly as defined in claim 1 wherein said lateral movement restriction means comprises a second enlarged area defined within said slot means to grip another of said spacer means located in said separation space to minimize lateral movement of said finger members.

8. The assembly as defined in claim 1 wherein said finger members are laterally resilient to allow temporary widening of said slot means for placement of said enlarged area around said spacer means.

9. The assembly as defined in claim 1 wherein said block surfaces are inclined outwardly in a downward direction.

10. The assembly as defined in claim 1 further including a flat spring means secured between said finger members and said block surfaces to give added resiliency to said lower sections of said finger members said flat spring means including a crimped section located between said block surface and said finger member to further hold said finger detachably secured to said spacer means.

11. A packer grid block assembly having detachable fingers for guiding articles into an orderly array to facilitate packing into receiving locations positioned therebelow which comprises:

(a) a plurality of approximately parallel and equally spaced grid plates;

(b) a plurality of support blocks secured to said grid plates at approximately equally spaced locations, said support blocks including two block surfaces at approximately 90° with respect to one another and about 45° with respect to said grid plates, said block surfaces being inclined outwardly in a downward direction and defining article receiving passages between two adjacent block surfaces of adjacent support blocks on a given grid plate and two adjacent block surfaces of adjacent support blocks on an adjacent grid plate;

(c) a plurality of cover plates each being fixedly secured to one of said block surfaces;

(d) securement means adapted to fixedly attach said cover plates to said block surfaces including spacer means fixedly positioned between said cover plates and said block surfaces to define a separation space therebetween;

(e) a plurality of elongated finger members of resilient material detachably attached indirectly to said grid plates by being detachably secured to said spacer means, said finger members being detachably positioned within said separation space, said finger members including inwardly facing surfaces thereof which cooperate with adjacent similarly configured fingers to define said article receiving passages for guiding articles into an orderly array for placement therebelow, said fingers further comprising:

(1) an upper neck portion located primarily within said separation space to detachably secure said finger members in place, said upper neck section including a slot means extending from the top thereof longitudinally downward with respect to said finger member, said slot means including at least one enlarged area being adapted to detachably grip around one of said spacer means, said elongated finger members being laterally flexibly resilient to allow said slot means to be temporarily widened for placement of said enlarged area around one of said spacer means; and (2) a lower section extending below said cover plate and inclined inwardly toward said article receiving passage to guide articles passing therethrough;

(f) lateral movement restriction means located between said finger members and said spacer means and said cover plate to limit lateral movement of said finger members when detachably secured within said separation space; and (g) flat spring means secured between said finger members and said block surfaces to give added resiliency to said lower sections of said finger members said flat spring means including a crimped section to further detachably secure said finger member to said spacer means.

* * * * *

UNITED STATES PATENT AND TRADEMARK OFFICE

CERTIFICATE OF CORRECTION

PATENT NO. : 4,170,096

DATED : October 9, 1979

INVENTOR(S) : Anton J. Wild

It is certified that error appears in the above-identified patent and that said Letters Patent are hereby corrected as shown below:

Column 7, line 6, from upwardly to inwardly.

Signed and Sealed this

*Sixteenth* Day of *September 1980*

[SEAL]

*Attest:*

SIDNEY A. DIAMOND

*Attesting Officer*

*Commissioner of Patents and Trademarks*